US007043167B2

(12) United States Patent
Ichikawa et al.

(10) Patent No.: US 7,043,167 B2
(45) Date of Patent: May 9, 2006

(54) IMAGE FORMATION DEVICE AND IMAGE FORMATION METHOD THAT SELECTIVELY ADAPTS A PROCESS OF FIXING AN IMAGE ON A MEDIUM

(75) Inventors: Kazuhiro Ichikawa, Nagano-ken (JP); Osamu Ishibashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/650,045

(22) Filed: Aug. 28, 2003

(65) Prior Publication Data

US 2005/0191063 A1 Sep. 1, 2005

(30) Foreign Application Priority Data

Aug. 30, 2002 (JP) ..... 2002-253744

(51) Int. Cl.
*G03G 15/00* (2006.01)

(52) U.S. Cl. ..... 399/12; 399/33; 399/67

(58) Field of Classification Search ..... 399/9, 399/13, 24, 27, 28, 33, 67, 68, 69, 12, 38
See application file for complete search history.

(56) References Cited

U.S. PATENT DOCUMENTS 5,325,165 A * 6/1994 Ohgita et al. ..... 399/321
5,918,087 A * 6/1999 Kimura et al. ..... 399/69
6,432,589 B1 * 8/2002 Uchinokura et al. ..... 430/18
6,763,219 B1 * 7/2004 Kobayashi et al. ..... 399/401

FOREIGN PATENT DOCUMENTS

JP 61-070571 A 4/1986
JP 63-231474 A 9/1988
JP 2001-356631 A 12/2001

* cited by examiner

*Primary Examiner*—Hoan Tran
(74) *Attorney, Agent, or Firm*—Sughrue Mion, PLLC

(57) ABSTRACT

The process of the invention determines whether toners of cyan (C), magenta (M), and yellow (Y) are all included in toner filled in a toner cartridge 40, based on color information of the toner read from a storage element 50 of the toner cartridge 40 (S100 and S110). When the toners of all these colors are included in the toner cartridge 40, the process sets parameter values for a color image to control parameters (a fixation temperature T, a fixation pressure P, and a preliminary revolving frequency R) of a fixation process (S120). When the toners of all these colors are not included in the toner cartridge 40, on the other hand, the process specifies formation of a monochromatic image and sets parameter values for the monochromatic image to the control parameters (S130). This arrangement effectively ensures adequate formation of a color image and a monochromatic image and desirably prevents excessive deterioration of constituents of an image formation device.

12 Claims, 5 Drawing Sheets

IMAGE FORMATION DEVICE AND IMAGE FORMATION METHOD THAT SELECTIVELY ADAPTS A PROCESS OF FIXING AN IMAGE ON A MEDIUM

BACKGROUND OF THE INVENTION

1. Field of the Invention

The present invention relates to an image formation device and an image formation method. More specifically, the invention relates to an image formation device that fixes toner images, which are transferred with toners of multiple colors onto a recording medium, such as paper, so as to form a color image, and a corresponding image formation method.

2. Description of the Prior Art

There are known image formation devices that are capable of forming both color images and monochromatic images, for example, color laser printers and color photocopiers. This image formation device forms a monochromatic image with only the toner of black color, in response to selection of formation of a monochromatic image through operations of an operation panel.

The prior art image formation device carries out an identical series of processing for formation of a color image and for formation of a monochromatic image, while the amount of toner used for formation of the monochromatic image is less than that used for formation of the color image. This applies unnecessary, excessive loads onto the respective constituents of the image formation device and thereby accelerates deterioration of the constituents.

SUMMARY OF THE INVENTION

An image formation device and a corresponding image formation method of the invention aim to ensure adequate formation of color images and monochromatic images. The image formation device and the corresponding image formation method of the invention also aim to prevent excessive deterioration of constituents of the image formation device.

In order to achieve at least a part of the above aim, the image formation device of the present invention is constructed as follows.

An image formation device of the present invention is a device that fixes toner images, which are transferred with toners of multiple colors onto a recording medium, such as paper, so as to form a color image, the image formation device including: a specification module that specifies either formation of a composite color image or formation of a monochromatic image; and a control module that, when the specification module specifies formation of the composite color image, controls to selectively adapt a fixation process, which fixes the transferred toner image on the recording medium, for formation of the composite color image, while controlling to selectively adapt the fixation process for formation of the monochromatic image when the specification module specifies formation of the monochromatic image.

The image formation device of the invention specifies either formation of a composite color image or formation of a monochromatic image and controls to adapt the fixation process for formation of the composite color image or for formation of the monochromatic image, based on the result of the specification. This arrangement ensures the adequate processing for formation of the composite color image or for formation of the monochromatic image, thus effectively preventing excessive deterioration of constituents involved in the fixation process. The formation of the composite color image or the formation of the monochromatic image may be specified, based on external information like printing instruction information and image data input from a computer connecting with the image formation device or input through operations of an operation panel of the image formation device or based on internal information like setting information of the image formation device.

In one modified structure, the image formation device of the invention may further include an information acquisition module that acquires information on color of toner filled in each toner cartridge from each of storage elements mounted on multiple toner cartridges, which are attached to the image formation device. In this modified structure, the specification module may specify formation of the composite color image or formation of the monochromatic image, based on the information on the color of toner acquired by the information acquisition module. In this modified structure, the composite color image may be formed with toners of at least three primary colors, cyan, magenta, and yellow, and the specification module may specify formation of the composite color image when the colors of toners filled in the multiple toner cartridges include all of the three primary colors, while specifying formation of the monochromatic image when the colors of toners filled in the multiple toner cartridges exclude at least one of the three primary colors. In the modified structure, further, the specification module may specify formation of the composite color image when the colors of toners filled in the multiple toner cartridges include any color other than black, while specifying formation of the monochromatic image when the colors of toners filled in the multiple toner cartridges are all black.

In the image formation device of the invention, the control module may control to carry out the fixation process at a first fixation temperature when the specification module specifies formation of the composite color image, while controlling to carry out the fixation process at a second fixation temperature, which is lower than the first fixation temperature, when the specification module specifies formation of the monochromatic image. The control module may further control to carry out the fixation process at a first fixation pressure when the specification module specifies formation of the composite color image, while controlling to carry out the fixation process at a second fixation pressure, which is lower than the first fixation pressure, when the specification module specifies formation of the monochromatic image. The control module may still further control to carry out the fixation process at a setting of a first revolving frequency to a preliminary revolving frequency of a fixation roller when the specification module specifies formation of the composite color image, while controlling to carry out the fixation process at a setting of a second revolving frequency, which is lower than the first revolving frequency, to the preliminary revolving frequency of the fixation roller when the specification module specifies formation of the monochromatic image. The settings of the fixation temperature, the fixation pressure, and the preliminary revolving frequency of the fixation roller in the case of formation of the monochromatic image are lower than the settings in the case of formation of the composite color image. This is because the amount of toner to be fixed on paper or another recording medium for formation of the monochromatic image is less than that for formation of the composite color image.

The technique of the present invention is not restricted to the image formation device described above, but is also applicable to an image formation method that fixes toner images, which are transferred with toners of multiple colors onto a recording medium so as to form a color image.

DESCRIPTION OF THE PREFERRED EMBODIMENTS

Figure 1:
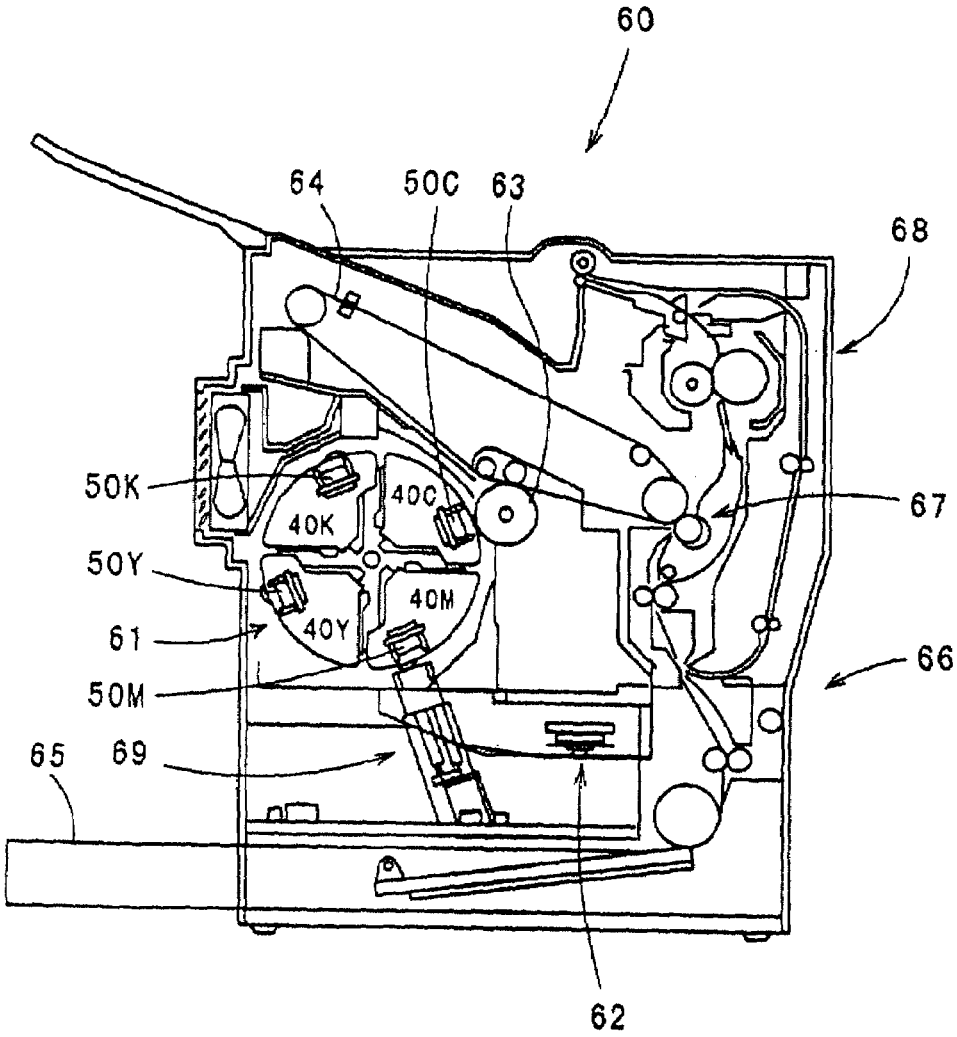
FIG. 1 schematically illustrates the structure of a color laser printer 60 in one embodiment.

One preferred embodiment of the invention is discussed below. FIG. 1 schematically illustrates the structure of a color laser printer 60 functioning as an image formation device in one embodiment of the invention. The color laser printer 60 of the embodiment is constructed as a full-color electrophotographic image formation device that adopts a single photoreceptor system and an intermediate transfer system. As illustrated, the color laser printer 60 includes an exposure unit 62 that irradiates the charged photoreceptor 63 with laser and thereby forms color-separated images of four colors, cyan (C), magenta (M), yellow (Y), and black (K), as electrostatic latent images on the photoreceptor 63, and a developer unit 61 that develops the electrostatic latent images formed on the photoreceptor 63 as toner images of the respective colors with corresponding color toners respectively fed from toner cartridges 40C, 40M, 40Y, and 40K attached to the developer unit 61. The color laser printer 60 further includes a primary transfer unit 71 that transfers the toner images of the respective colors developed on the photoreceptor 63 onto a transfer belt 64 in an overlapping manner to form a composite color toner image, a feeder unit 66 that conveys printing paper from a paper cassette 65, a secondary transfer unit 67 that further transfers the composite color toner image formed on the transfer belt 64 onto the conveyed printing paper, a fixation unit 68 that fixes the transferred composite color toner image on the printing paper and delivers the printing paper with the fixed composite color toner image, and a controller 70 that controls all the operations of the color laser printer 60.

Figure 2:
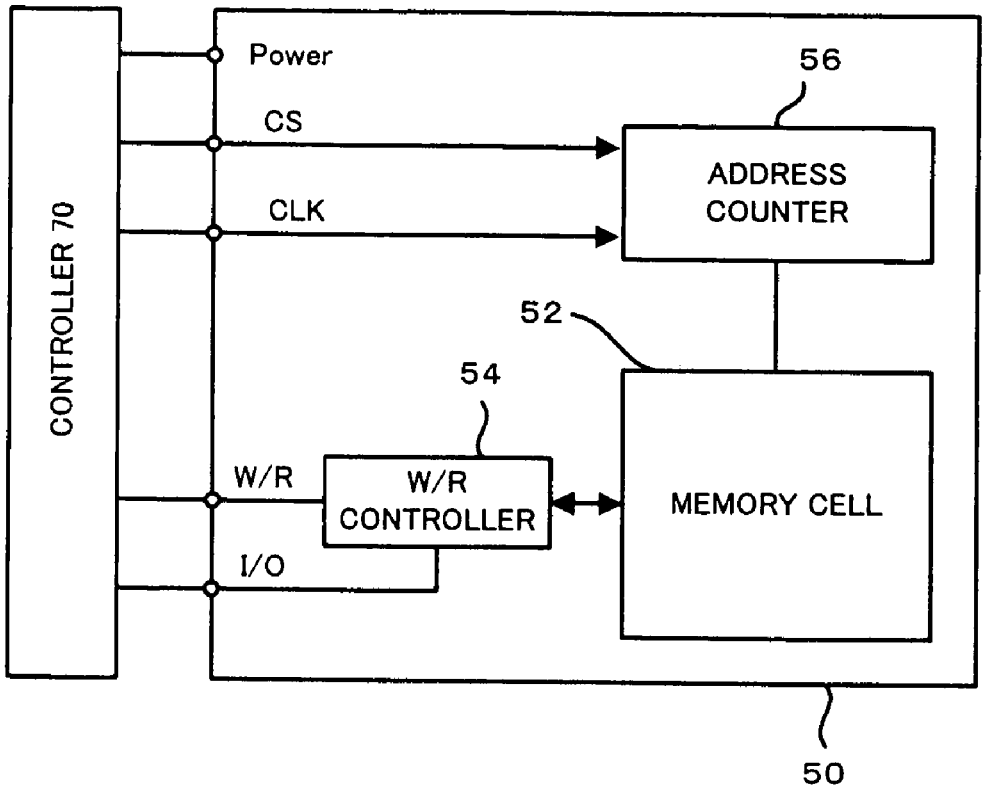
FIG. 2 shows the electrical connection of the controller 70 with each of the storage elements 50.

The developer unit 61 is rotatable to make each of the toner cartridges 40C, 40M, 40Y, and 40K attached to the developer unit 61 face the photoreceptor 63. The toner cartridges 40C, 40M, 40Y, and 40K respectively have storage elements 50C, 50M, 50Y, and 50K. The controller 70 reads information on the color of toner filled in each toner cartridge via a movable connector 69, which connects with each of the storage elements 50 moved to be located at a lower right position in the drawing. FIG. 2 shows the electrical connection of the controller 70 with each of the storage elements 50. As illustrated, the storage element 50 includes a memory cell 52 that stores data, a read-write controller 54 that controls operations of reading and writing data from and into the memory cell 52, and an address counter 56 that counts up in the process of data transmission to and from the controller 70 of the color laser printer 60 via the read-write controller 54 in response to a clock signal CLK. An EEPROM is a typical example of the storage element 50.

Figure 3:
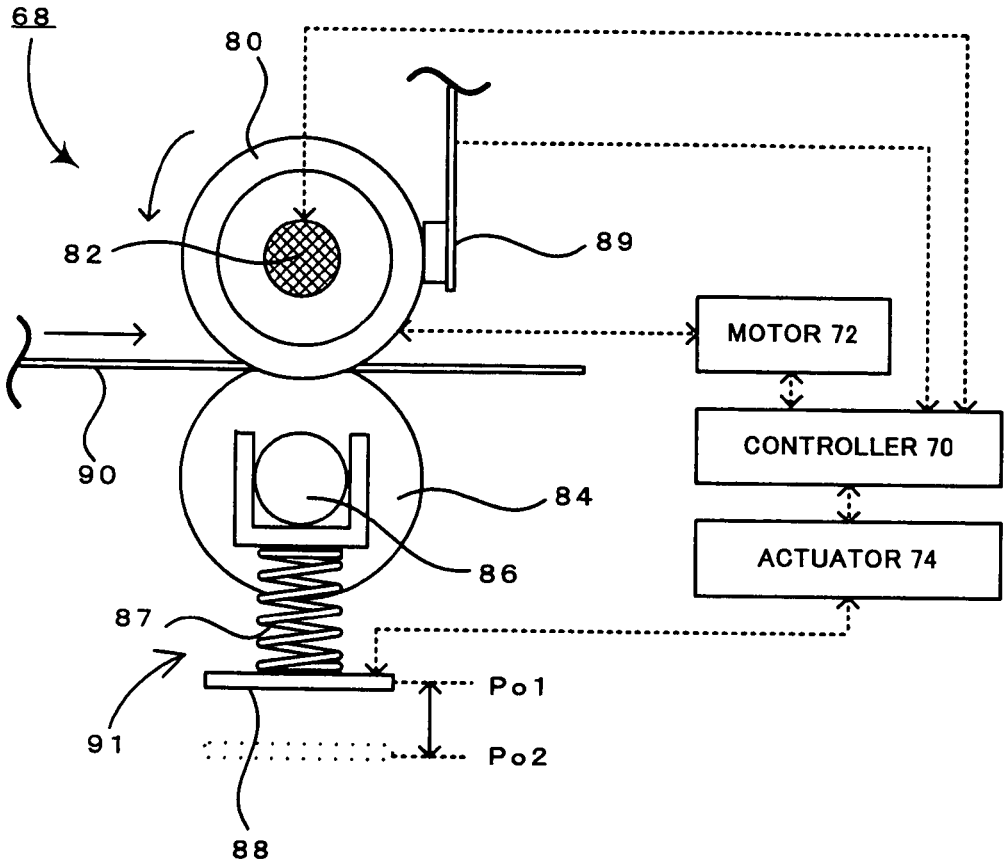
FIG. 3 is an enlarged view illustrating the fixation unit 68.

FIG. 3 is an enlarged view schematically illustrating the fixation unit 68. As illustrated, the fixation unit 68 has a fixation roller 80 and a pressure roller 84 and is controlled by the controller 70. The fixation roller 80 includes a heater 82, such as a halogen lamp, that generates heat through power supply, and rotates with driving force of a motor 72. The pressure roller 84 is formed to have an elastic layer of, for example, rubber surrounding a metal shaft 86 of, for example, aluminum or iron, and is supported in a rotatable manner to be in contact with the fixation roller 80. A temperature sensor 89, such as a thermistor, is attached to the fixation roller 80 to measure the surface temperature of the fixation roller 80 heated by the heater 82. The observed surface temperature is input into the controller 70 via a signal line and an input port (not shown). The pressure roller 84 has a pressurization unit 91, where a spring 87 having one end supported by a support member 88 presses the pressure roller 84 against the fixation roller 80. The support member 88 is designed to be movable between a position Po1 and a position Po2 by the functions of an actuator 74. This positional change regulates the pressing force of the spring 87 to press the pressure roller 84 against the fixation roller 80. The controller 70 receives the observed surface temperature of the fixation roller 80 mentioned above and other input signals (for example, a printing instruction signal given by an operator) and executes actuation control of the motor 72 and the actuator 74 and power supply control of the heater 82, based on these input signals. In the fixation unit 68 thus constructed, when a sheet of printing paper 90 with a composite color toner image transferred thereon is fed in the direction of an arrow to a nip between the fixation roller 80 rotating in the direction of an arrow and the pressure roller 84 driven with friction, the composite color toner image transferred on the surface of the printing paper 90 is heated and pressurized to be fixed thereon by means of the fixation roller 80, which is heated to a preset temperature by the heater 82, and the pressure roller 84, which is regulated to a preset pressing force by the pressurization unit 91.

The controller 70 is constructed as a microprocessor including a CPU and controls an operation of reading color information of the toner from the storage element 50, actuation of the fixation unit 68, and a variety of other operations of the respective constituents of the color laser printer 60. The exposure unit 62, the primary transfer unit 71, the feeder unit 65, and the secondary transfer unit 67 are identical with those included in conventional color laser printers and color photocopiers and are not specifically described here.

Figure 4:
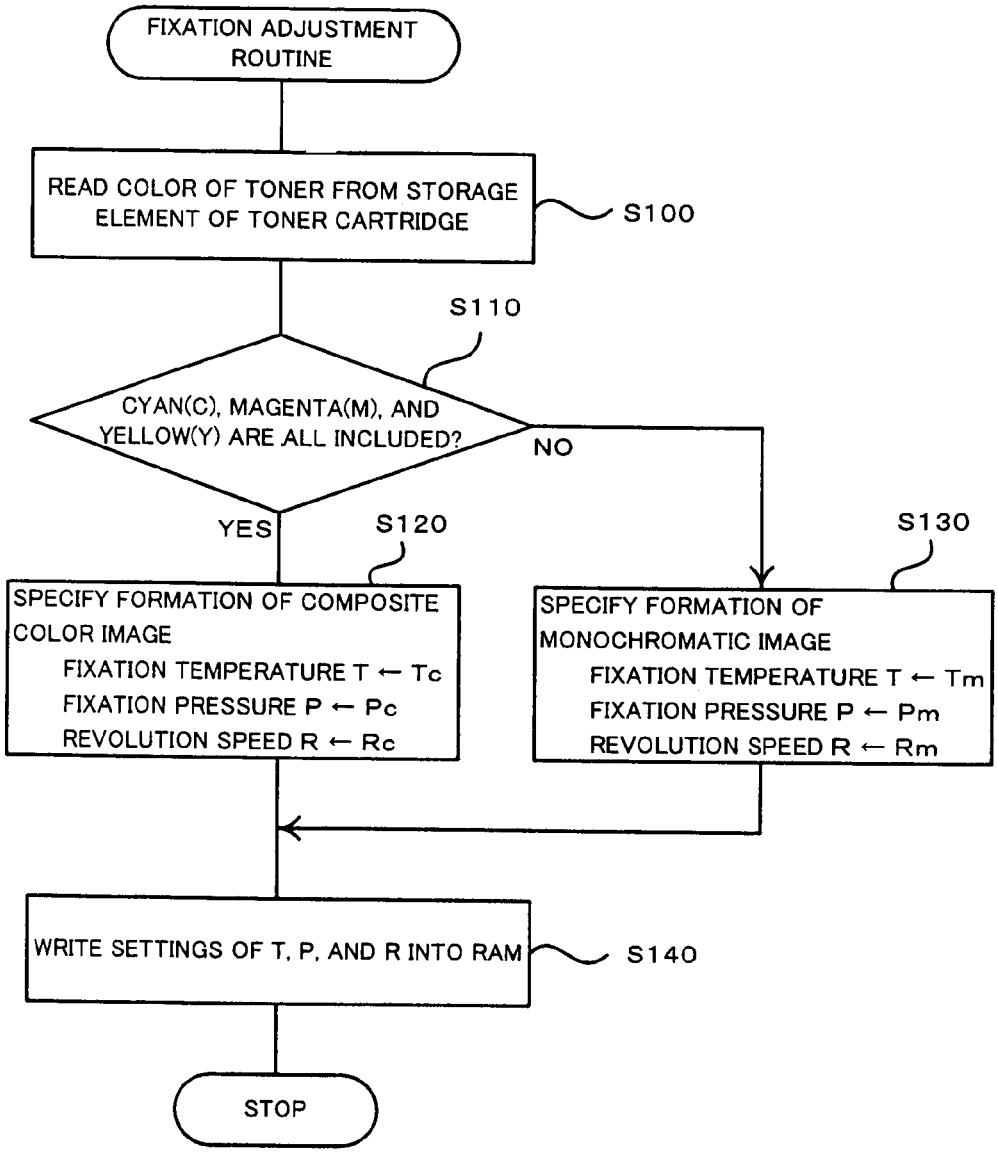
FIG. 4 is a flowchart showing a fixation adjustment routine.

The following describes the operations of the color laser printer 60 in the embodiment and specifically a fixation process of fixing a toner image transferred on the printing paper with the fixation unit 68 and a process of setting control parameters used for the fixation process. FIG. 4 is a flowchart showing a fixation adjustment routine, which is executed by the controller 70 in response to a power ON operation of the color laser printer 60 or in response to attachment of the toner cartridge 40 to the color laser printer 60. The fixation adjustment routine sets control parameters used for the fixation process discussed later. When the fixation adjustment routine starts, the controller 70 first reads color information of the toner filled in the toner cartridge 40 from the storage element 50 of the toner cartridge 40 attached to the color laser printer 60 (step S100). According to a concrete procedure, the controller 70 outputs a read signal to the read-write controller 54 of the storage element 50 of the toner cartridge 40 connecting with the movable connector 69 of the color laser printer 60.

The controller 70 subsequently determines whether toners of cyan (C), magenta (M), and yellow (Y) are all included in the toner filled in the toner cartridge 40 attached to the color laser printer 60, based on the read-out color information of the toner (step S110). When the toners of all these colors are included in the toner cartridge 40, the controller 70 specifies formation of a composite color image, sets parameter values for a color image (fixation temperature Tc, fixation pressure Pc, and preliminary revolving frequency Rc) to control parameters of the fixation process (a fixation temperature T, a fixation pressure P, and a preliminary revolving frequency R), and writes the settings of the control parameters at a preset address in a RAM (not shown) of the controller 70 (steps S120 and S140). When the toners of all these colors are not included in the toner cartridge 40, that is, when any of the toners of cyan (C), magenta (M), and yellow (Y) is absent, on the other hand, the controller 70 specifies formation of a monochromatic image, sets parameter values for a monochromatic image (fixation temperature Tm, fixation pressure Pm, and preliminary revolving frequency Rm) to the control parameters of the fixation process, and writes the settings of the control parameters at the preset address in the RAM (steps S130 and S140). After the processing, the fixation adjustment routine is terminated. Here the fixation temperature T represents the surface temperature of the fixation roller 80 to fix the toner image on the printing paper. The fixation pressure P represents the pressure acting on the nip between the pressure roller 84 and the fixation roller 80 to fix the toner image on the printing paper. The preliminary revolving frequency R represents the number of preliminary rotations to preheat the fixation roller 80 and the pressure roller 84. The parameter values for the monochromatic image are set, such that the fixation temperature Tm is lower than the fixation temperature Tc for the color image (for example, Tc=190° C. and Tm=140° C.), the fixation pressure Pm is lower than the fixation pressure Pc for the color image, and the preliminary revolving frequency Rm is lower than the preliminary revolving frequency Rc (for example, Rc=20 rotations and Rm=10 rotations). In the case of formation of a monochromatic image, the toner image to be fixed on the printing paper is formed with only the toner of black (K). The amount of toner used for formation of a monochromatic image is thus less than the amount of toner used for formation of a color image. Namely the toner image for formation of the monochromatic image can be fixed at the lower fixation temperature and under the lower fixation pressure, compared with the toner image for formation of the color image. The lower fixation temperature requires the less number of preliminary rotations for preheating. In the structure of the embodiment, the positions Po1 and Po2 of the support member 88 are adjusted to give the fixation pressure Pc for the color image at the position Po1 and to give the fixation pressure Pm for the monochromatic image at the position Po2.

Figure 5:
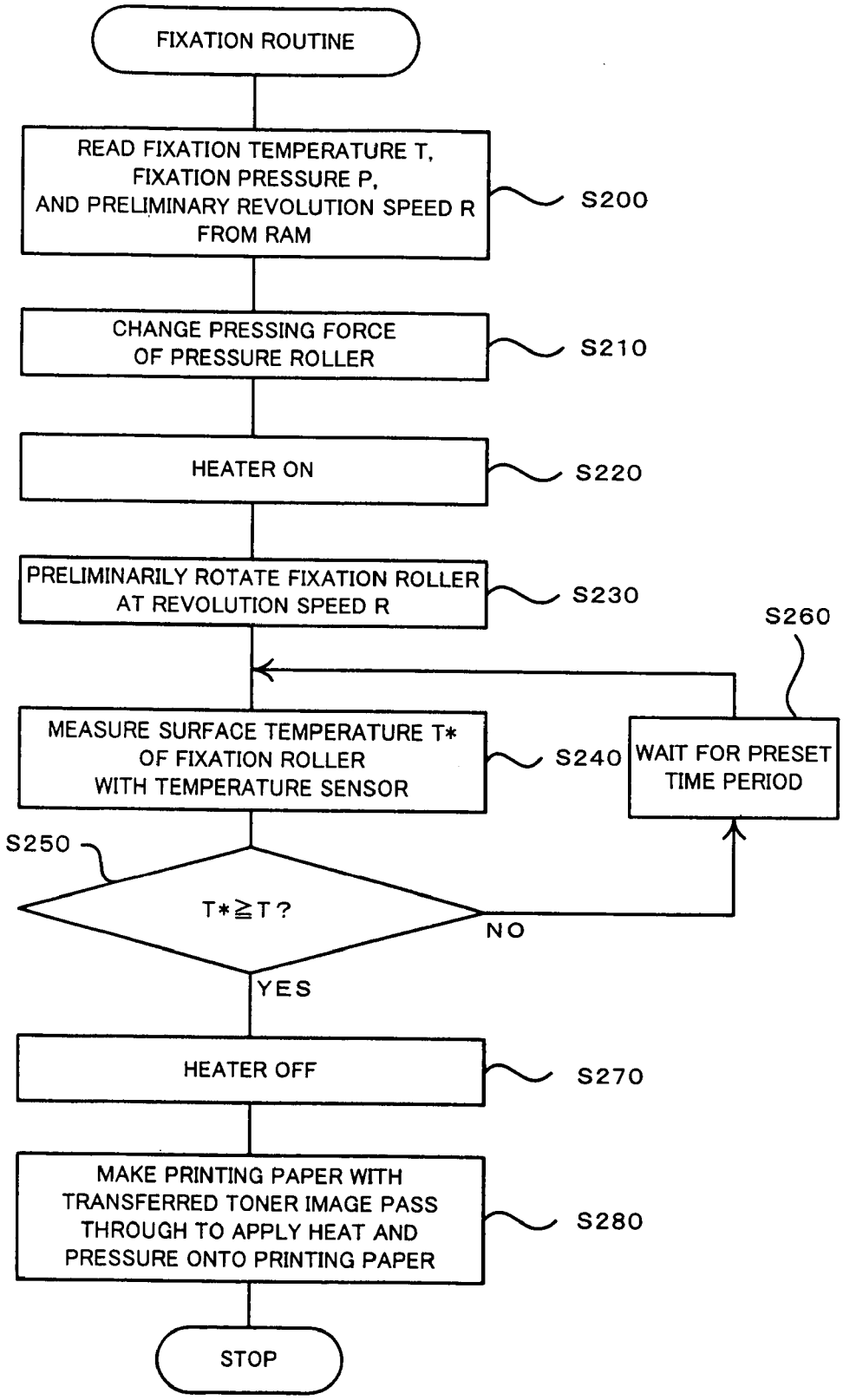
FIG. 5 is a flowchart showing a fixation routine.

The following describes the fixation process to fix the toner image transferred on the printing paper with the fixation unit 68. FIG. 5 is a flowchart showing a fixation routine, which is executed by the controller 70 when the controller 70 receives image data and starts formation of an image. When the fixation routine starts, the controller 70 first reads the settings of the control parameters (the fixation temperature T, the fixation pressure P, and the preliminary revolving frequency R) from the RAM (step S200). These control parameters have been set in advance corresponding to formation of the color image or formation of the monochromatic image by the fixation adjustment routine.

The controller 70 changes the pressing force of the pressure roller 84 against the fixation roller 80, based on the read-out setting of the fixation pressure P (step S210). When the setting of the fixation pressure P is equal to the parameter value Pc for the color image, the support member 88 is located at the position Po1. When the setting of the fixation pressure P is equal to the parameter value Pm for the monochromatic image, on the other hand, the support member 88 is located at the position Po2. The spring 87 is compressed to a greater degree under the parameter value Pc for the color image than that under the parameter value Pm for the monochromatic image. The compression of the spring 87 to the greater degree increases the pressing force of the pressure roller 84 against the fixation roller 80, which is produced by the elastic power of the spring 87.

The controller 70 subsequently supplies power to the heater 82 to heat the fixation roller 80 (step S220), and preliminarily rotates the fixation roller 80 for preheating the fixation roller 80 and the pressure roller 84 (step S230). Here the number of the preliminary rotations is identical with the preliminary revolving frequency R read out at step S200.

After preheating the fixation roller 80 and the pressure roller 84 by the preliminary rotations, the controller 70 activates the temperature sensor 89 to measure a surface temperature T* of the fixation roller 80 (step S240) and compares the observed surface temperature T* with the fixation temperature T read out at step S200 (step S250). When the observed surface temperature T* has not yet reached the fixation temperature T (in the case of T*<T), the controller 70 waits for a preset time period (for example, for 2 seconds) and goes back to step S240 to measure the surface temperature T* again. When the observed surface temperature T* has reached the fixation temperature T (in the case of T*≧T) by the preliminary rotations of the fixation roller 80 and the heat generated by the heater 82, the controller 70 cuts off the power supply to the heater 82 (step S270) and makes the printing paper with the toner image transferred thereon pass through the nip formed between the fixation roller 80 and the pressure roller 84 to apply heat and pressure onto the printing paper and thereby fix the toner image on the printing paper (step S280). The fixation routine is here terminated. While the processing of step S270 is completed in this fixation routine (that is, while the observed surface temperature T* of the fixation roller 80 has reached the fixation temperature T and the power supply to the heater 82 is cut off), the electrostatic latent image, which is formed on the photoreceptor 63 based on image data input into the controller 70, is developed and primarily transferred as a toner image on the transfer belt 64 and is then secondarily transferred onto the printing paper by the secondary transfer unit 67. The printing paper with the secondarily transferred toner image thereon is fixed at step S280.

As described above, the color laser printer 60 of the embodiment reads the color of toner filled in the toner cartridge 40 from the storage element 50 of the toner cartridge 40, specifies formation of a composite color image or formation of a monochromatic image, sets the control parameters of the fixation process by the fixation unit 68 according to the result of the specification, and carries out the fixation process with the settings of the control parameters. The arrangement of the embodiment ensures adequate fixation for formation of the composite color image or for formation of the monochromatic image. This desirably relieves the load on the constituents of the fixation unit 68 in the case of formation of the monochromatic image and prevents the excessive deterioration of the constituents. The arrangement also ensures easy specification of either formation of the composite color image or formation of the monochromatic image, based on the information on the color of toner read from the storage element 50 of the toner cartridge 40.

The movable connector 69 included in the color laser printer 60 of the embodiment corresponds to the information acquisition module of the invention. The controller 70 executing the fixation adjustment process and the fixation process corresponds to the specification module and the control module of the invention.

The color laser printer 60 of the embodiment determines whether the toners of cyan (C), magenta (M), and yellow (Y) are all included in the toner filled in the toner cartridge 40 attached to the color laser printer 60, based on the color information of the toner read from the storage element 50 of the toner cartridge 40, and specifies either formation of a composite color image or formation of a monochromatic image. Another method may alternatively be applied to specify formation of the composite color image or formation of the monochromatic image, as long as the specification is based on the read-out color information of the toner. One modified procedure may specify formation of a composite color image when the toner of any color other than black (K) is included in the toner filled in the toner cartridge 40 attached to the color laser printer 60, while specifying formation of a monochromatic image when only the toner of black (K) is included. The information on the color of the toner read from the storage element 50 of the toner cartridge 40 may be a serial number or a rot number of the toner cartridge 40. The color of the toner is identified, based on the read-out serial number or rot number.

The color laser printer 60 of the embodiment sets the fixation temperature T, the fixation pressure P, and the preliminary revolving frequency R as the control parameters of the fixation process. One possible modification may set only one or two among these parameters. The control parameters to be set are not restricted to this example. A diversity of other control parameters are applicable, as long as they have different parameter values for formation of a color image from those for formation of a monochromatic image.

The color laser printer 60 of the embodiment reads the color of the toner from the storage element 50 of the toner cartridge 40 and specifies formation of a composite color image or formation of a monochromatic image. Another method may be applied to specify formation of the composite color image or formation of the monochromatic image. For example, specification of either formation of a composite color image or formation of a monochromatic image may be based on printing instruction information or image data input from a computer connecting with the color laser printer 50 or input through operations of an operation panel of the laser printer 60.

The color laser printer 60 of the embodiment is constructed as a full-color electrophotographic image formation device that adopts the single photoreceptor system and the intermediate transfer system. The requirement is simply to read the information on the color of the toner from the storage element 50 of the toner cartridge 40. The technique of the invention is thus also applicable to a color laser printer or a color photocopier constructed as a full-color electrophotographic image formation device that adopts a multiple photoreceptor system or a direct transfer system.

The embodiment regards the color laser printer 60 that fixes toner images transferred with toners of multiple colors onto a recording medium, such as paper, so as to form a color image. The technique of the invention is also actualized by a corresponding image formation method of forming a color image in such a way.

The above embodiment is to be considered in all aspects as illustrative and not restrictive. There may be many modifications, changes, and alterations without departing from the scope or spirit of the main characteristics of the present invention. All changes within the meaning and range of equivalency of the claims are therefore intended to be embraced therein.

What is claimed is:

1. An image formation device that fixes toner images, which are transferred with toners of multiple colors onto a recording medium, such as paper, so as to form a color image, said image formation device comprising:

a specification module that specifies either formation of a composite color image or formation of a monochromatic image;

a control module that, when said specification module specifies formation of the composite color image, controls to selectively adapt a fixation process, which fixes the transferred toner image on the recording medium, for formation of the composite color image, while controlling to selectively adapt the fixation process for formation of the monochromatic image when said specification module specifies formation of the monochromatic image; and an information acquisition module that acquires information on color of toner filled in each toner cartridge from each of storage elements mounted on multiple toner cartridges, which are attached to said image formation device, wherein said specification module specifies formation of the composite color image or formation of the monochromatic image, based on the information on the color of toner acquired by said information acquisition module.

2. An image formation device in accordance with claim 1, wherein the composite color image is formed with toners of at least three primary colors, cyan, magenta, and yellow, and said specification module specifies formation of the composite color image when the colors of toners filled in said multiple toner cartridges include all of the three primary colors, while specifying formation of the monochromatic image when the colors of toners filled in said multiple toner cartridges exclude at least one of the three primary colors.

3. An image formation device in accordance with claim 1, wherein said specification module specifies formation of the composite color image when the colors of toners filled in said multiple toner cartridges include any color other than black, while specifying formation of the monochromatic image when the colors of toners filled in said multiple toner cartridges are all black.

4. An image formation device in accordance with claim 1, wherein said control module controls to carry out the fixation process at a first fixation temperature when said specification module specifies formation of the composite color image, while controlling to carry out the fixation process at a second fixation temperature, which is lower than the first fixation temperature, when said specification module specifies formation of the monochromatic image.

5. An image formation device in accordance with claim 1, wherein said control module controls to carry out the fixation process at a first fixation pressure when said specification module specifies formation of the composite color image, while controlling to carry out the fixation process at a second fixation pressure, which is lower than the first fixation pressure, when said specification module specifies formation of the monochromatic image.

6. An image formation device in accordance with claim 1, wherein said control module controls to carry out the fixation process at a setting of a first revolving frequency to a preliminary revolving frequency of a fixation roller when said specification module specifies formation of the composite color image, while controlling to carry out the fixation process at a setting of a second revolving frequency, which is lower than the first revolving frequency, to the preliminary revolving frequency of the fixation roller when said specification module specifies formation of the monochromatic image.

7. An image formation method that fixes toner images, which are transferred with toners of multiple colors onto a recording medium, such as paper, so as to form a color image, said image formation method comprising the steps of:

(a) specifying either formation of a composite color image or formation of a monochromatic image; and (b) controlling to selectively adapt a fixation process, which fixes the transferred toner image on the recording medium, for formation of the composite color image when formation of the composite color image is specified in said step(a), while controlling to selectively adapt the fixation process for formation of the monochromatic image when formation of the monochromatic image is specified in said step(a);

wherein said step(a) specifies formation of the composite color image or formation of the monochromatic image, based on information on color of toner filled in each toner cartridge acquired from each of storage elements mounted on multiple toner cartridges, which are attached to an image formation device.

8. An image formation method in accordance with claim 7, wherein the composite color image is formed with toners of at least three primary colors, cyan, magenta, and yellow, and said step(a) specifies formation of the composite color image when the colors of toners filled in said multiple toner cartridges include all of the three primary colors, while specifying formation of the monochromatic image when the colors of toners filled in said multiple toner cartridges exclude at least one of the three primary colors.

9. An image formation method in accordance with claim 7, wherein said step(a) specifies formation of the composite color image when the colors of toners filled in said multiple toner cartridges include any color other than black, while specifying formation of the monochromatic image when the colors of toners filled in said multiple toner cartridges are all black.

10. An image formation method in accordance with claim 7, wherein said step(b) controls to carry out the fixation process at a first fixation temperature when said step(a) specifies formation of the composite color image, while controlling to carry out the fixation process at a second fixation temperature, which is lower than the first fixation temperature, when said step(a) specifies formation of the monochromatic image.

11. An image formation method in accordance with claim 7, wherein said step(b) controls to carry out the fixation process at a first fixation pressure when said step(a) specifies formation of the composite color image, while controlling to carry out the fixation process at a second fixation pressure, which is lower than the first fixation pressure, when said step(a) specifies formation of the monochromatic image.

12. An image formation method in accordance with claim 7, wherein said step(b) controls to carry out the fixation process at a setting of a first revolving frequency to a preliminary revolving frequency of a fixation roller when said step(a) specifies formation of the composite color image, while controlling to carry out the fixation process at a setting of a second revolving frequency, which is lower than the first revolving frequency, to the preliminary revolving frequency of the fixation roller when said step(a) specifies formation of the monochromatic image.

* * * * *